US006261149B1

(12) United States Patent
Moore

(10) Patent No.: US 6,261,149 B1
(45) Date of Patent: Jul. 17, 2001

(54) REVERSIBLE DOLL TOY

(76) Inventor: Shane A. Moore, 722 Smith St., Fort Collins, CO (US) 80524

( * ) Notice: Subject to any disclaimer, the term of this patent is extended or adjusted under 35 U.S.C. 154(b) by 0 days.

(21) Appl. No.: 09/552,831

(22) Filed: Apr. 20, 2000

(51) Int. Cl.[7] ..... A63H 3/02
(52) U.S. Cl. ..... 446/369; 446/71
(58) Field of Search ..... 446/71, 72, 73, 446/268, 320, 321

(56) References Cited

U.S. PATENT DOCUMENTS 4,413,442 * 11/1983 McSweeney .
4,795,398 * 1/1989 Waxler ..... 446/327
4,842,565 * 6/1989 VonPhilip, Sr. ..... 446/321
5,090,938 * 2/1992 Reynolds ..... 446/369
5,224,894 * 7/1993 Nelson et al. ..... 446/73
5,791,963 * 8/1998 Lieberman ..... 446/27
6,126,507 * 10/2000 Lieberman ..... 446/327

* cited by examiner

*Primary Examiner*—Jacob K. Ackun, Jr.
*Assistant Examiner*—Faye Francis

(57) ABSTRACT

A reversible doll toy for amusing children and adults with a transformative toy that resembles a child and a muffin. The reversible doll toy includes a soft doll comprising a first covering including a first surface that includes an appearance of an exterior of a muffin and a second covering that includes a second surface with an appearance representative of an exterior of a child. The first covering is secured to the second covering such that the first and second surfaces form opposite first and second sides of a panel comprised of first and second coverings. The panel is invertable such that the sides are alternately exposed to view and hidden from view.

5 Claims, 2 Drawing Sheets

REVERSIBLE DOLL TOY

BACKGROUND OF THE INVENTION

1. Field of the Invention

The present invention relates to doll toys and more particularly pertains to a new reversible doll toy for amusing children and adults with a transformative toy that resembles a child and a muffin.

2. Description of the Prior Art

The use of doll toys is known in the prior art. More specifically, doll toys heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,639,233; 4,842,565; 2,195,127; 3,811,220; 3,851,419; and U.S. Pat. Des. No. 308,401.

While these devices fulfill their respective, particular objectives and requirements, the aforementioned patents do not disclose a new reversible doll toy. The inventive device includes a soft doll comprising a first covering including a first surface that includes an appearance of an exterior of a muffin and a second covering that includes a second surface with an appearance representative of an exterior of a child. The first covering is secured to the second covering such that the first and second surfaces form opposite first and second sides of a panel comprised of first and second coverings, and the panel is invertable such that the sides are alternately exposed to view and hidden from view.

In these respects, the reversible doll toy according to the present invention substantially departs from the conventional concepts and designs of the prior art, and in so doing provides an apparatus primarily developed for the purpose of for amusing children and adults with a transformative toy that resembles a child and a muffin.

SUMMARY OF THE INVENTION

In view of the foregoing disadvantages inherent in the known types of doll toys now present in the prior art, the present invention provides a new reversible doll toy construction wherein the same can be utilized for amusing children and adults with a transformative toy that resembles a child and a muffin.

The general purpose of the present invention, which will be described subsequently in greater detail, is to provide a new reversible doll toy apparatus and method which has many of the advantages of the doll toys mentioned heretofore and many novel features that result in a new reversible doll toy which is not anticipated, rendered obvious, suggested, or even implied by any of the prior art doll toys, either alone or in any combination thereof.

To attain this, the present invention generally comprises a soft doll comprising a first covering including a first surface that includes an appearance of an exterior of a muffin and a second covering that includes a second surface with an appearance representative of an exterior of a child. The first covering is secured to the second covering such that the first and second surfaces form opposite first and second sides of a panel comprised of first and second coverings, and the panel is invertable such that the sides are alternately exposed to view and hidden from view.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reversible doll toy apparatus and method which has many of the advantages of the doll toys mentioned heretofore and many novel features that result in a new reversible doll toy which is not anticipated, rendered obvious, suggested, or even implied by any of the prior art doll toys, either alone or in any combination thereof.

It is another object of the present invention to provide a new reversible doll toy which may be easily and efficiently manufactured and marketed.

It is a further object of the present invention to provide a new reversible doll toy which is of a durable and reliable construction.

An even further object of the present invention is to provide a new reversible doll toy which is susceptible of a low cost of manufacture with regard to both materials and labor, and which accordingly is then susceptible of low prices of sale to the consuming public, thereby making such reversible doll toy economically available to the buying public.

Still yet another object of the present invention is to provide a new reversible doll toy which provides in the apparatuses and methods of the prior art some of the advantages thereof, while simultaneously overcoming some of the disadvantages normally associated therewith.

Still another object of the present invention is to provide a new reversible doll toy for amusing children and adults with a transformative toy that resembles a child and a muffin.

Yet another object of the present invention is to provide a new reversible doll toy which includes a soft doll comprising a first covering including a first surface that includes an appearance of an exterior of a muffin and a second covering that includes a second surface with an appearance representative of an exterior of a child. The first covering is secured to the second covering such that the first and second surfaces form opposite first and second sides of a panel comprised of first and second coverings, and the panel is invertable such that the sides are alternately exposed to view and hidden from view.

Still yet another object of the present invention is to provide a new reversible doll toy that permits a child to have the creativity of two dolls within one object.

Even still another object of the present invention is to provide a new reversible doll toy that encourages children to develop thinking skills in reversing the doll toy from one view to another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
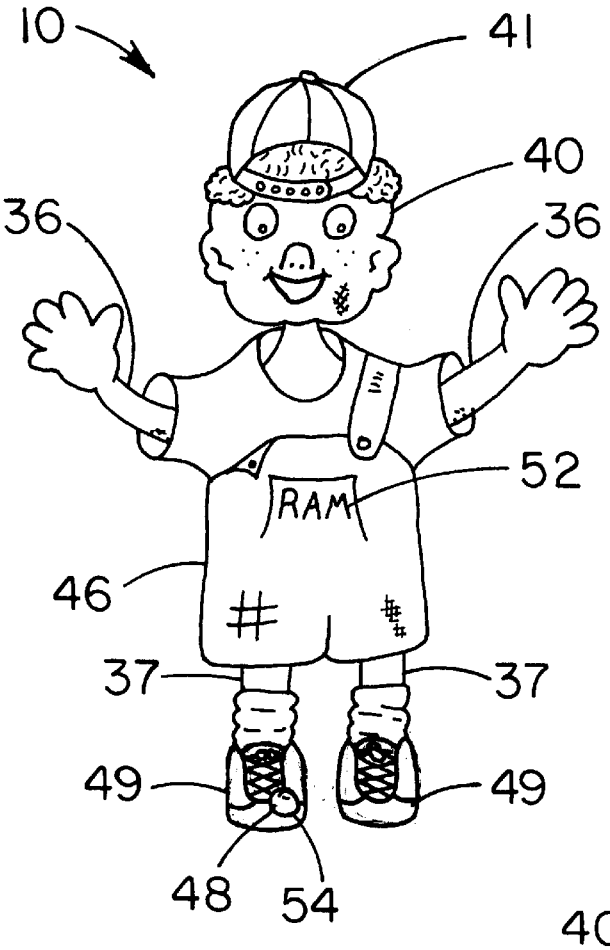
FIG. 1 is a schematic front view of a new reversible doll toy according to the present invention that reveals a second surface that resembles a child.
Figure 2:
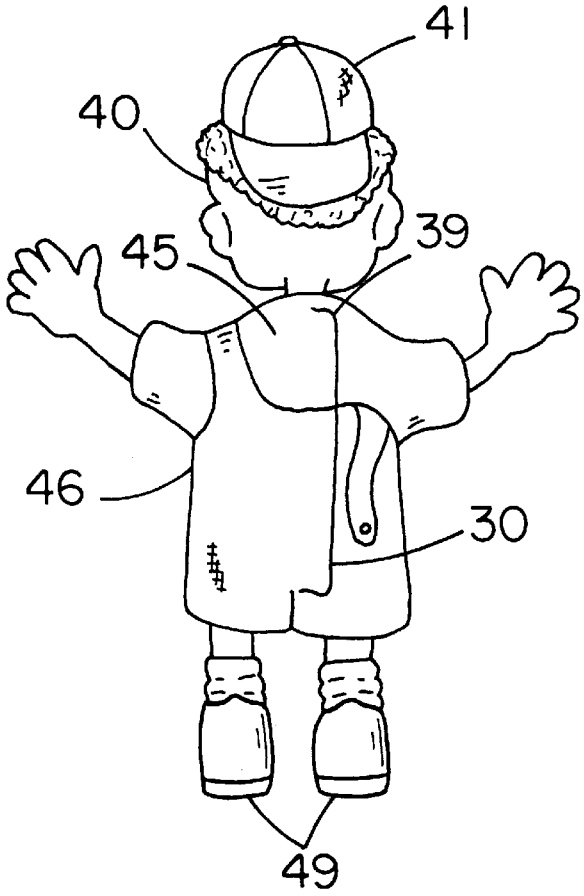
FIG. 2 is a schematic rear view of the present invention.
Figure 3:
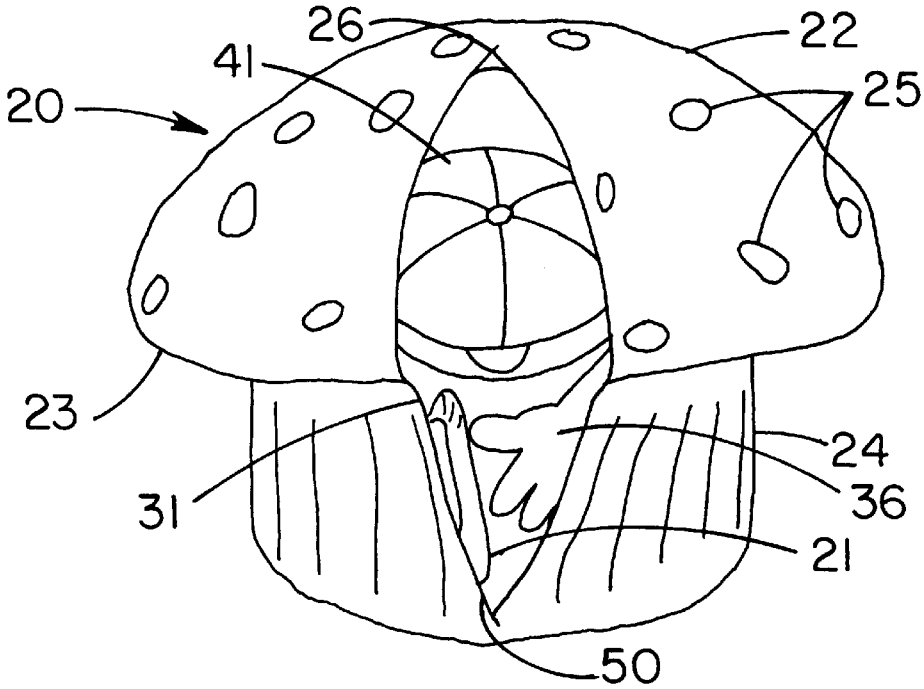
FIG. 3 is a schematic front view of the present invention revealing the first surface that resembles a muffin.
Figure 4:
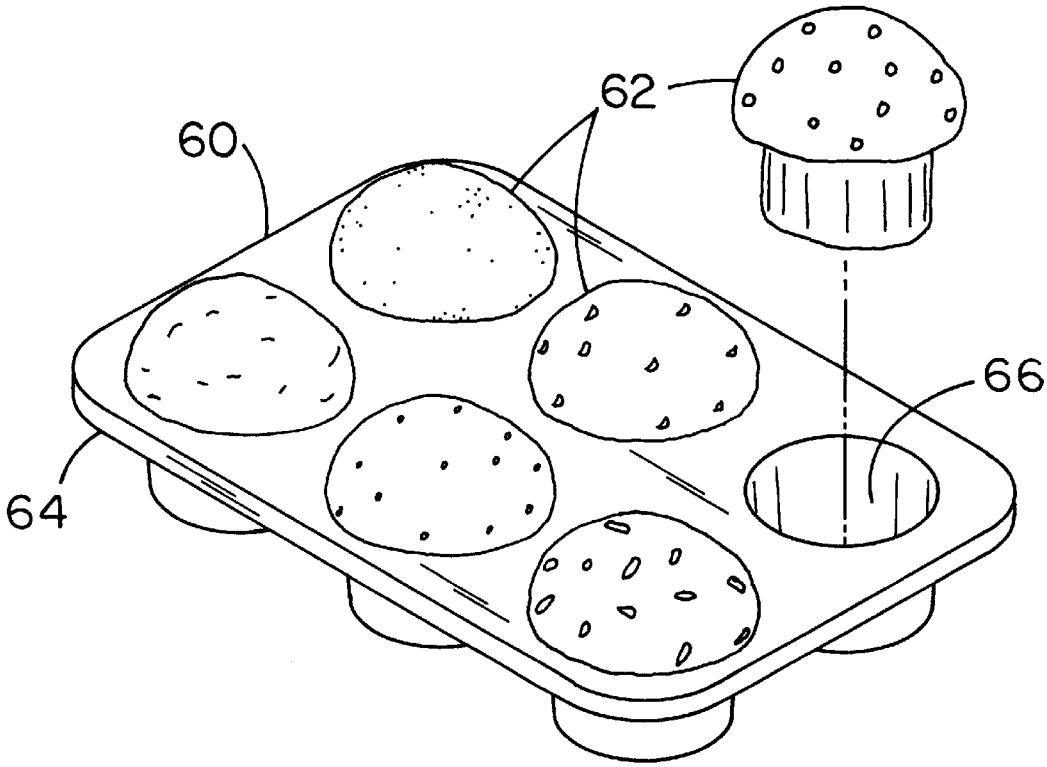
FIG. 4 is a schematic perspective view of a plurality of the soft dolls of the present invention positioned in a holder.

With reference now to the drawings, and in particular to FIGS. 1 through 4 thereof, a new reversible doll toy embodying the principles and concepts of the present invention and generally designated by the reference numeral 10 will be described.

As best illustrated in FIGS. 1 through 4, the reversible doll toy 10 generally comprises a soft doll with a first covering including a first surface that includes an appearance of an exterior of a muffin, and a second covering that includes a second surface with an appearance representative of an exterior of a child. The first covering is secured to the second covering such that the first and second surfaces form opposite first and second sides of a panel comprised of the first and second coverings, and the panel is invertable such that the sides are alternately exposed to view and hidden from view.

The first covering 20 includes a first surface 21 with an appearance representative of an exterior of a muffin 22, a cap portion 23 and a trunk portion 24. The cap portion 23 is mounted on a top of the trunk portion 24 and includes a plurality of speckles 25 thereon. Ideally, the speckles 25 may resemble different types of fruits or food items, including chocolate chips or nuts. The first covering 20 has a split in a side 26 extending from the cap portion 23 to the trunk portion 24 for accessing the second covering 30.

The second covering 30 includes a second surface 31 with an appearance representative of an exterior of a child 32. The second covering 30 preferably has a torso portion 45 and a plurality of appendage portions 34. The plurality of appendage portions 34 include a head portion 40, a pair of arm portions 36, and a pair of leg portions 37. The head portion 40 may include a cap representation 41 mounted thereon, the torso portion 45 may include an overall pants representation 46 mounted thereon, and the leg portions 37 may each include an end with a shoe representation 49 mounted thereon.

Ideally, the head portion 40 may resemble a child of various ages, such as infancy through eight years of age. In another embodiment of the invention, the features of the head portion 40 may resemble a muffin when the head portion 40 is inverted. In one embodiment of the invention, the shoe representation 49 mounted on the leg portion 36 may not entirely cover an end 48, thus leaving an amount of the leg portion 36 that resembles a toe 54 exposed through the shoe representation 49. In another embodiment, the overall pants representation 46 may have lettering 52 attached to the front side.

The first covering 20 is secured to the second covering 30 such that the first 21 and second 31 surfaces form opposite first 28 and second 38 sides of a panel 50 comprised of the first 20 and second 30 coverings. The panel 50 is invertable such that the sides are alternately exposed to view and hidden from view. The second covering 30 has a split in a rear surface 39 of the torso portion 45 for accessing the first covering 20.

Ideally, the reversible doll toy additionally comprises a holder 60 for a plurality of the soft reversible doll toys 62. The holder 60 comprises a muffin baking pan 64 that includes at least six tub portions 66. Thus, in one embodiment of the invention, a plurality of the reversible dolls that are exposing the first covering 20 while placed in the tub portions 66 could resemble muffins in a muffin baking pan 64.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soft doll comprising:

a first covering having a first surface with an appearance representative of an exterior of a muffin;

a second covering having a second surface with an appearance representative of an exterior of a child;

wherein the first covering is secured to the second covering such that the first and second surfaces form opposite first and second sides of a panel comprised of the first and second coverings, the panel being invertable such the sides are alternately exposed to view and hidden from view; and a holder for a plurality of the soft dolls, the holder comprising a muffin baking pan, the muffin baking pan having six tub portions.

2. The doll of claim 1 wherein the first covering has a cap portion and a trunk portion, the cap portion being mounted on a top of the trunk portion, the cap portion having a plurality of speckles thereon, wherein the first covering has a split in a side extending from the cap portion to the trunk portion for accessing the second covering.

3. The doll of claim 1 wherein the second covering has a torso portion and a plurality of appendage portions, the plurality of appendage portions including a head portion, a pair of arm portions, and a pair of leg portions.

4. The doll of claim 3 wherein the head portion has a cap representation mounted thereon, the torso portion having an overall pants representation mounted thereon, the leg portions each having an end with a shoe representation mounted thereon, wherein the second covering has a split in a rear surface of the torso portion for accessing the first covering.

5. A soft doll comprising:

first covering having a first surface with an appearance representative of an exterior of a muffin;

a second covering having a second surface with an appearance representative of an exterior of a child;

wherein the first covering is secured to the second covering such that the first and second surfaces form opposite first and second sides of a panel comprised of the first and second coverings, the panel being invertable such the sides are alternately exposed to view and hidden from view;

wherein the first covering has a cap portion and a trunk portion, the cap portion being mounted on a top of the trunk portion, the cap portion having a plurality of speckles thereon, wherein the first covering has a split in a side extending from the cap portion to the trunk portion for accessing the second covering;

wherein the second covering has a torso portion and a plurality of appendage portions, the plurality of appendage portions including a head portion, a pair of arm portions, and a pair of leg portions, the head portion having a cap representation mounted thereon, the torso portion having an overall pants representation mounted thereon, the leg portions each having an end with a shoe representation mounted thereon, wherein the second covering has a split in a rear surface of the torso portion for accessing the first covering;

additionally comprising a holder for a plurality of the soft dolls, the holder comprising a muffin baking pan, the muffin baking pan having six tub portions.

* * * * *